US005524563A

United States Patent [19]

Huddleston

[11] Patent Number: 5,524,563

[45] Date of Patent: Jun. 11, 1996

[54] SYSTEM FOR AUTOMATICALLY SEWING AN IMITATION CUFF

[75] Inventor: Erie G. Huddleston, Dacula, Ga.

[73] Assignee: Atlanta Attachment Company, Inc., Lawrenceville, Ga.

[21] Appl. No.: 504,141

[22] Filed: Jul. 18, 1995

[51] Int. Cl.[6] ..... D05B 35/02

[52] U.S. Cl. ..... 112/141

[58] Field of Search ..... 112/141, 153, 112/122, 126

[56] References Cited

U.S. PATENT DOCUMENTS

| | | | |
|---|---|---|---|
| 2,180,424 | 11/1939 | Mackenzie | 112/141 X |
| 3,906,877 | 9/1975 | Rockerath et al. | 112/141 |
| 4,040,366 | 8/1977 | Silverman et al. | 112/141 X |
| 4,066,025 | 1/1978 | Speer | 112/141 X |
| 4,660,486 | 4/1987 | Arbter | 112/304 X |
| 5,044,289 | 9/1991 | Keeton | 112/141 X |
| 5,410,975 | 5/1995 | Dudek et al. | 112/304 X |

*Primary Examiner*—Paul C. Lewis

*Attorney, Agent, or Firm*—James A. Hinkle; David L. Principe

[57] ABSTRACT

An attachment for a sewing machine which automatically conveys and folds cloth into an imitation cuff prior to sewing. The attachment comprises a conveyor which is modified to accept a tuck fold blade, an imitation cuff folder and an edge trimmer. After the material is conveyed through the edge trimmer, the imitation cuff folder forms an edge fold and a tuck fold in the material, as it is conveyed to the sewing area. The imitation cuff folder has two slots which guide the cloth into the two folds. The material is positioned in the folder by an edge fold tongue, which is attached to the imitation cuff folder and by the tuck fold blade which guides a portion from the center of the cloth into the tuck fold slot. The attachment converts to a plain hem configuration by retracting the tuck fold blade and adjusting the position of the edge trimmer.

18 Claims, 8 Drawing Sheets

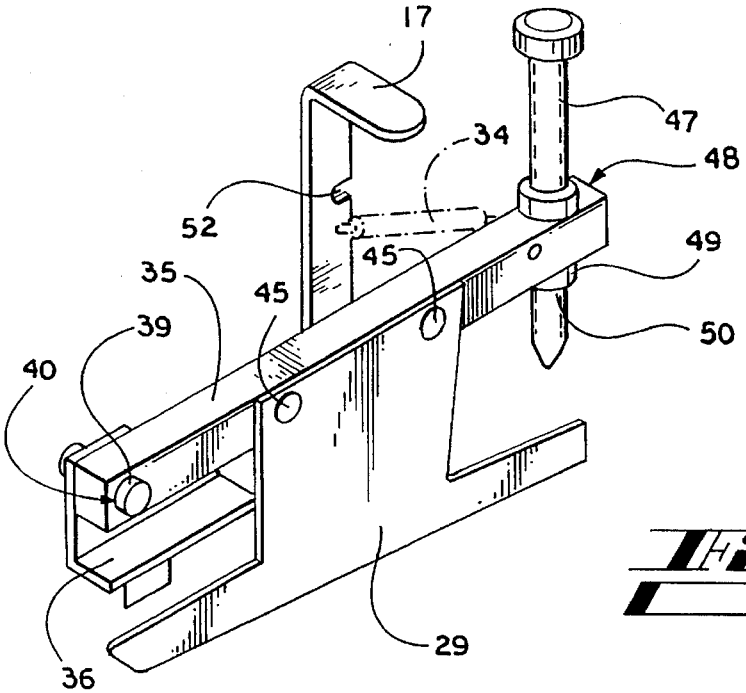
Fig_5
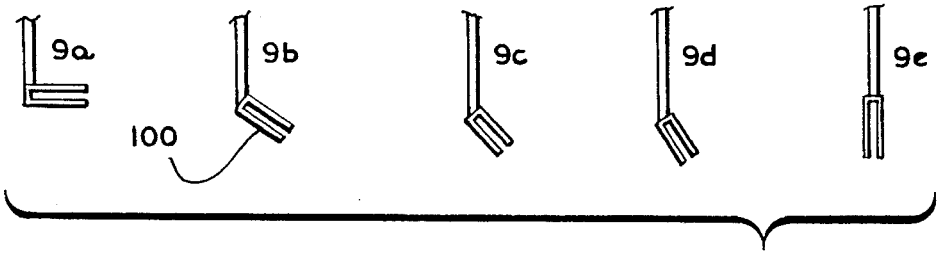
Fig_9
Fig_8
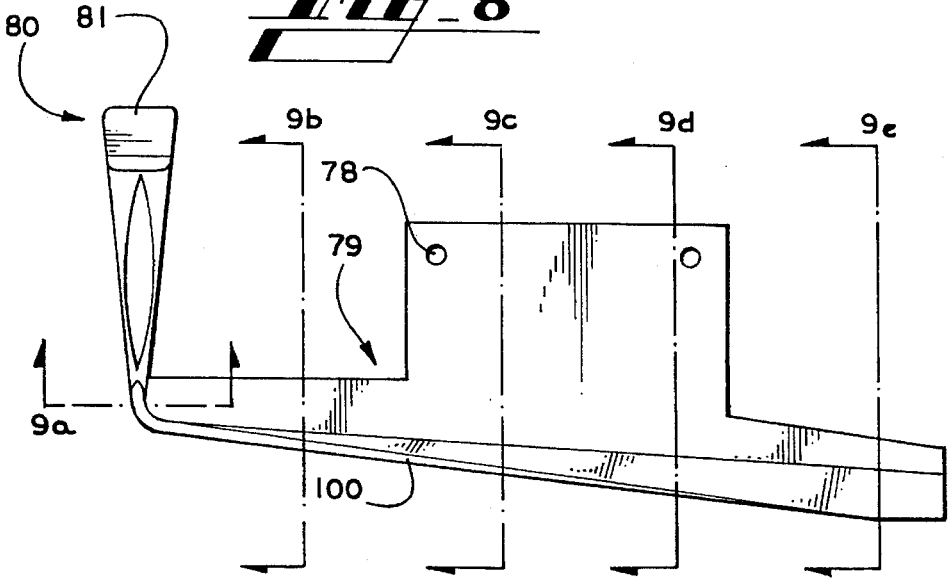

SYSTEM FOR AUTOMATICALLY SEWING AN IMITATION CUFF

BACKGROUND OF THE INVENTION

1. Field of the Invention

The present invention relates generally to a system for automatically sewing an imitation cuff.

2. Description of the Related Art

In the manufacture of garments, a cuff or band of material is commonly used to finish the end of a sleeve. The cuff is usually formed by either turning back a part of the sleeve or by attaching a separate piece of material. An imitation cuff is a method of turning back a part of the sleeve to create a cuff. Although the cuff is created by folding the sleeve, it gives the appearance of a cuff formed by attaching a separate piece of material. In the Federal Standard for stitches, seams, and stitchings, the imitation cuff is illustrated in the seam type LSdd-2 of Federal Standard No. 751a. The imitation cuff may be enhanced with the addition of piping as shown in the illustration.

The imitation cuff offers many advantages over the traditional method of creating a cuff. First, the imitation cuff method decreases the amount of labor associated with the garment. By reducing the number of pieces in the garment, there is a corresponding reduction in the amount of marker making and cloth cutting required.

Second, the imitation cuff may reduce color matching problems. The two-piece cuff can introduce color matching problems between the sleeve and the separate piece for the cuff. Depending on the placement of the patterns on the marker, the pieces for the sleeve and the cuff may come from different rolls of cloth. It is not uncommon for cloth colors to vary slightly from one roll to another roll due to differences in the colors of the individual threads which arise during the manufacturing process. Thus, the two-piece construction of a cuff may cause a color variation which is much less likely with an imitation cuff.

Third, the imitation cuff eliminates alignment problems which may arise with printed or striped material. If a two-piece cuff is created with this type of material, the stripes or print on the extra piece for the cuff may need to be aligned with the stripes or print on the sleeve. This alignment creates an additional step in the manufacturing process which is eliminated through the imitation cuff.

The prior art includes manual imitation cuff folders which can be used to make the proper cloth folds prior to sewing. These folders are not practical in an automated sewing environment and are used primarily in low technology applications. The folders are labor intensive as they require the operator to push the material through the folder. As the material travels through the folder, the material is folded along its length in the imitation cuff configuration. Depending on the makeup of the fabric, it may be difficult or even impossible to push the material through the folder. For example, light weight materials and knits will pose the greatest problems to manual feeding. These materials may stretch and deform or create other problems with regard to the consistency of the cuff along the line to be sewn.

SUMMARY OF THE INVENTION

The present invention comprises a system for automatically sewing an imitation cuff at the hem of a sleeve. The system comprises a conveyor which conveys the unfinished sleeves, through an edge trimmer and a folder, to the feed dog on the sewing machine. The edge trimmer is positioned adjacent to the conveyor and trims the right side of the material as it is conveyed toward the feed dog. The material is trimmed prior to being folded and sewn in order to ensure that the hemline is straight and squared. After being trimmed the material is conveyed through a folder to form an imitation cuff. The imitation cuff folder forms two folds which include an edge or hem fold and a tuck fold. In order to form the folds, the imitation cuff folder has two material pick-up points which guide the material into slots in the folder.

The first pick-up point is at the front of a tuck fold slot. The tuck fold slot is positioned on the outer surface of the imitation cuff folder. This outer surface is juxtaposed with the bottom side of the conveyor. The conveyor has a tuck fold blade which extends down through the bottom of the conveyor and into the tuck fold slot. As the material is conveyed toward the feed dog, the tuck fold blade pushes a portion of the material downward into the tuck fold slot. This material forms a loop which travels along the tuck fold slot until it is folded up and under the hem fold by a tuck fold guide. The folding of the loop of material up and under the hem fold is accomplished at the end of the imitation cuff folder in a position next to the feed dog.

The second material pick-up point is an edge fold tongue which extends upward from the outer surface of the folder to create a projection which catches the material and guides the material into an edge fold slot. Once the material is inside the edge fold slot, an edge fold guide folds the edge of the material back under the rest of the sleeve and guides it toward the end of the imitation cuff folder. At the end of the edge fold guide, the edge or hem fold is completed. After the edge fold emerges onto the outer surface of the folder from the edge fold slot, the edge is tucked underneath the sleeve. The amount of material folded underneath to form the edge fold must be maintained at a set amount so that the edge fold covers the trimmed edge of the material.

As the material reaches the end of the folder near the feed dog, the material has an edge or hem fold and a tuck fold nested underneath the hem fold to form an imitation cuff. It is important that the imitation cuff fold be maintained in its folded position as it moves to the feed dog. Accordingly, the completed fold is made as near to the feed dog as possible to prevent the material from coming unfolded prior to sewing. Also, the material contact side of the conveyor may be equipped with a recessed groove for holding the folds in place.

If the need arises to sew a plain hem instead of an imitation cuff, the system is easily converted to a standard hemmer. In order to convert the system, the tuck fold blade is retracted from the opening in the bottom of the conveyor. With the tuck fold blade retracted, the edge trimmer can be moved inward as the extra material for the fold is no longer necessary. The edge trimmer can be moved inward by means of a handle attached to the edge trimmer assembly.

Accordingly, it is an object of the present invention to provide a system for automatically sewing an imitation cuff on a sleeve.

Another object of the present invention is to provide an imitation cuff system which allows for a maximum rate of production on an automated sewing station.

It is another object of the present invention to provide a system for automatically sewing an imitation cuff which can easily be converted to a normal hemming station.

It is another object of the present invention to provide a system for sewing an imitation cuff which can be adapted for use with sewing machines that are sewing a top cover stitch, a bottom cover stitch, and both a top and bottom coverstitch.

These and other objects, features, and advantages of the present invention may be more clearly understood and appreciated from a review of the following detailed description of the disclosed embodiment and by reference to the appended drawings and claims.

BRIEF DESCRIPTION OF THE DRAWINGS

FIG. 5 is a detailed perspective view of the tuck fold blade of the present invention.

FIG. 8 is a side elevation view of an alternate tuck fold blade which may be utilized to introduce piping to the imitation cuff fold;

FIG. 9*a* is a sectional side view of a portion of the alternate tuck fold blade taken along the line 9*a*—9*a* of FIG. 8;

FIG. 9*b* is a sectional side view of a portion of the alternate tuck fold blade taken along the line 9*b*—9*b* of FIG. 8;

FIG. 9*c* a sectional side view of a portion of the alternate tuck fold blade taken along the line 9*c*—9*c* of FIG. 8;

FIG. 9*d* a sectional side view of a portion of the alternate tuck fold blade taken along the line 9*d*—9*d* of FIG. 8;

FIG. 9*e* a sectional side view of a portion of the alternate tuck fold blade taken along the line 9*e*—9*e* of FIG. 8;

DESCRIPTION OF THE PREFERRED EMBODIMENTS

Figure 1:
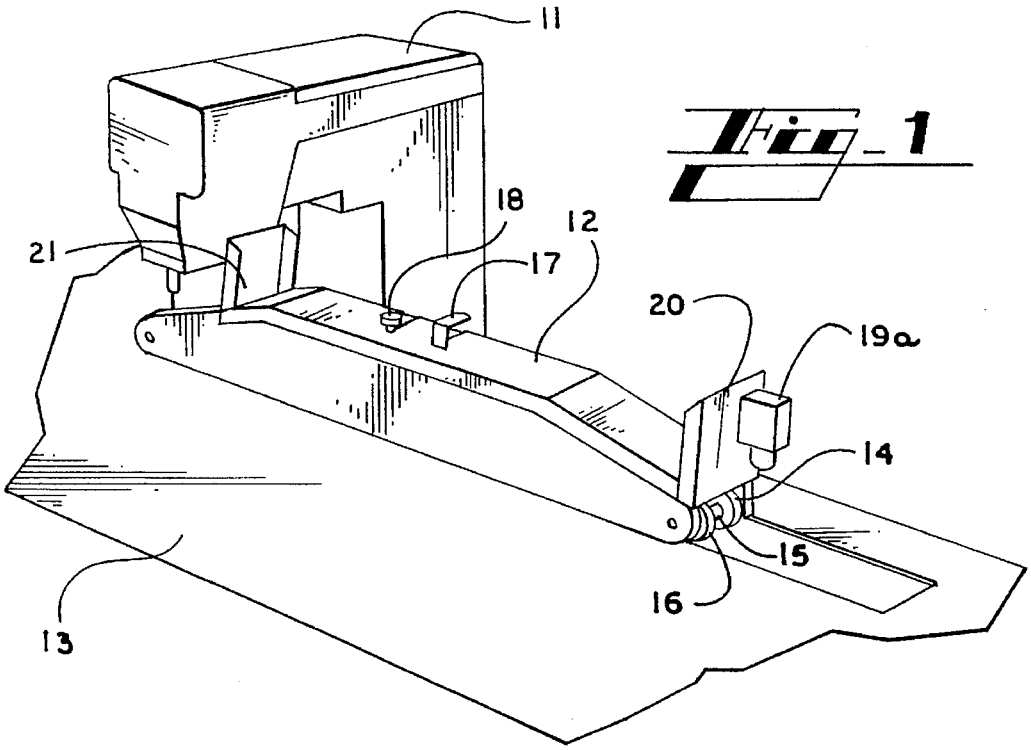
FIG. 1 is a perspective view of the system of the present invention positioned adjacent to a standard coverstitch sewing machine.

Referring to the drawings wherein like reference numerals designate corresponding parts throughout the several figures, and initially referring to FIG. 1 showing a perspective view of the present invention, a sewing machine 11 is shown with the system of the present invention attached to the sewing platform 13. The conveyor 12 extends perpendicular to the sewing machine from a point adjacent to the feed dog. The conveyor has a set of chains 16 which convey the material in a straight path to the feed dog. The chains attach to two idler sprockets 14 on a front axle 15 at the inlet end of the conveyor opposite the feed dog. The inlet end of the conveyor may have an electric eye 19*a* which senses the presence of material. If the electric eye does not sense material for a set period of time, the power supply to the sewing machine is cut off. The electric eye is mounted to a bracket 20. Also, the conveyor has a handle 17 and an adjustable thumbscrew 18 which adjust a tuck fold blade which is shown best in FIG. 5. At the outlet end of the conveyor 12, there is a bracket 21 for mounting another electric eye 19*b*. This electric eye 19*b* (not shown) senses the presence of material at the outlet of the conveyor and if triggered, causes the machine to start sewing.

Figure 2A:
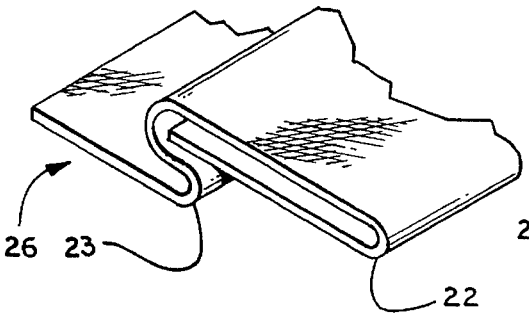
FIG. 2*a* is a perspective view of an imitation cuff fold.
Figure 2B:
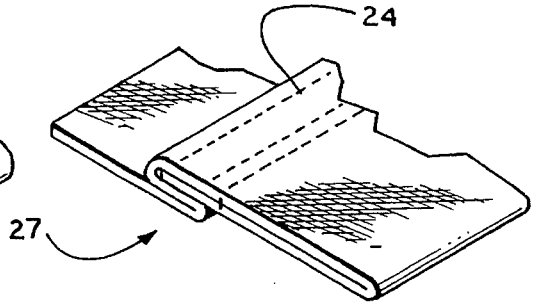
FIG. 2*b* is a perspective view of an imitation cuff with a bottom coverstitch.
Figure 2C:
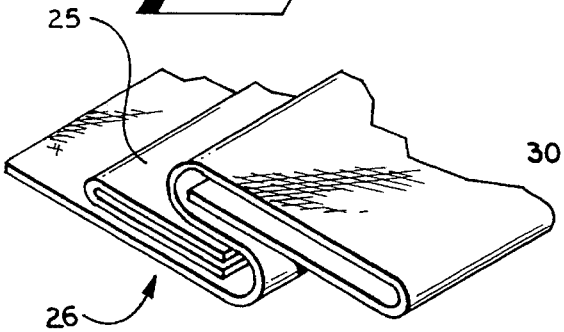
FIG. 2*c* is a perspective view of an imitation cuff with piping.
Figure 2D:
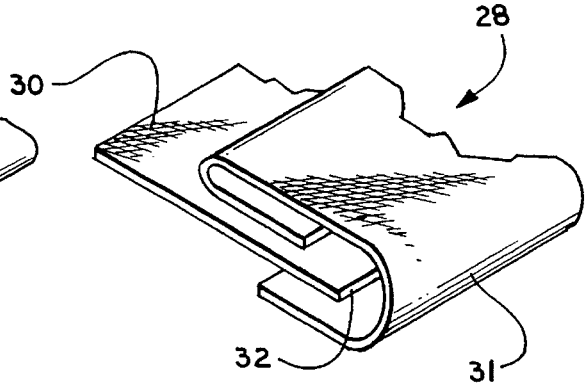
Fig 2D PRIOR ART
FIG. 2*d* is a perspective view of a prior art two-piece cuff.
Figure 2E:
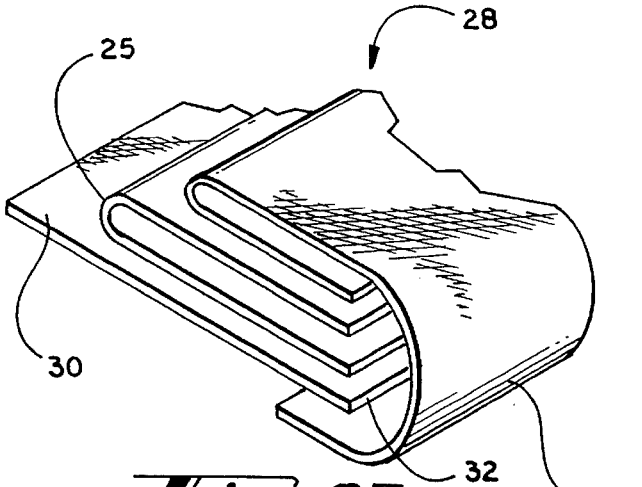
Fig 2E PRIOR ART
FIG. 2*e* is a perspective view of a prior art two-piece cuff with piping.

FIGS. 2*a* through 2*e* illustrate the various type of folds that are possible with the system of the present invention, and-the folds that can be replaced by the system of the present invention. Referring to FIG. 2*a*, an imitation cuff fold 26 is formed by first making an edge or hem fold 22 with the end of a piece of material. Next, a tuck fold 23 is formed in an overlapping fashion with the rough edge of the first fold. Referring to FIG. 2*b*, a sewn imitation cuff 27 is shown with a bottom coverstitch 24. In FIG. 2*c*, an imitation cuff fold 26 is shown with piping 25. As an alternative, the piping 25 may have a cord inserted into its fold. FIG. 2d shows a prior art two-piece cuff 28. The sleeve 30 has a piece of cuff material 31 folded around the edge 32 of the sleeve. FIG. 2*e* shows a prior art two-piece cuff 28 with piping 25. Again, the cuff material 31 is folded around the edge 32 of the sleeve 30.

Figures 3, 4:
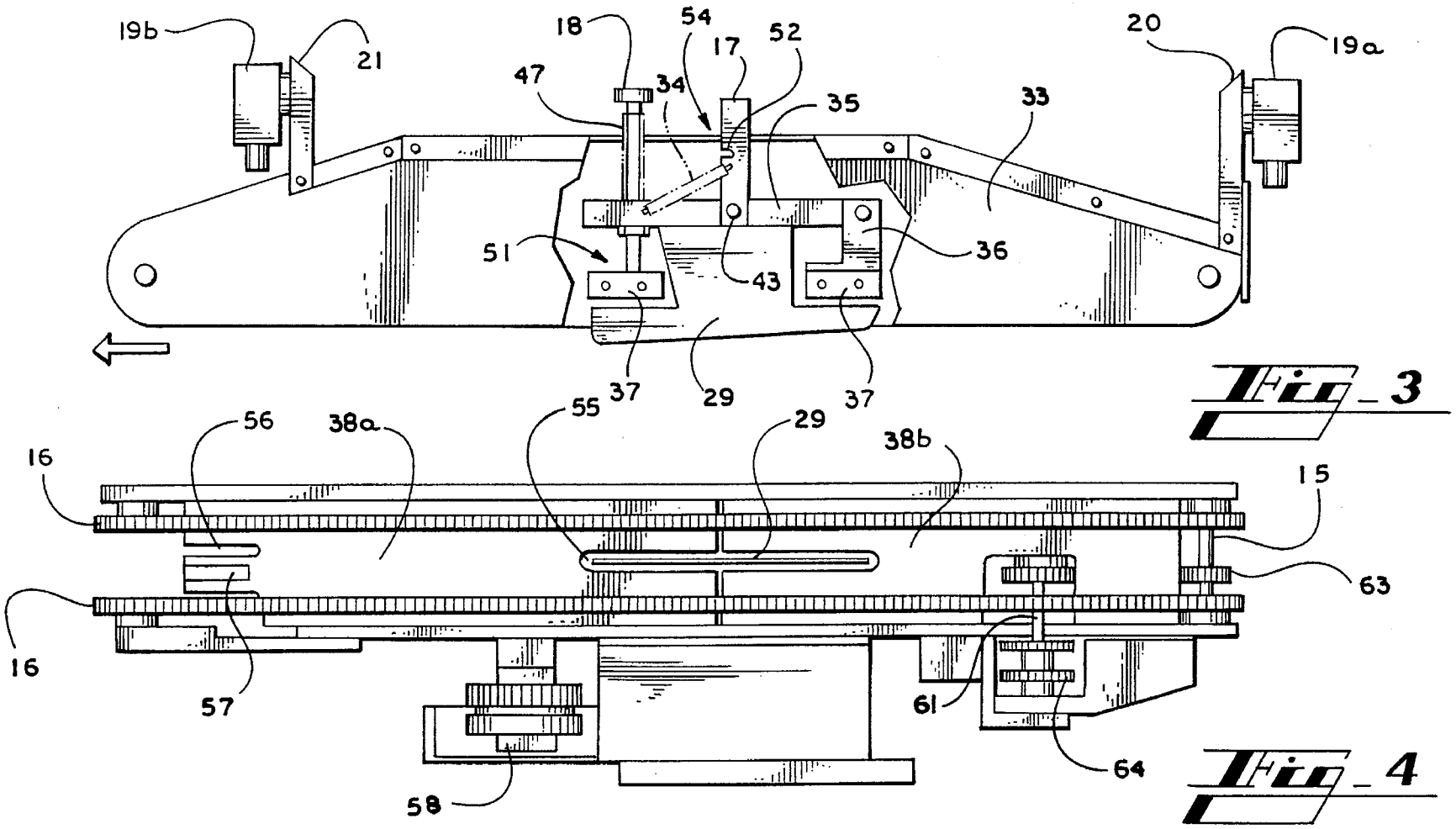
FIG. 3 is a partially cut away side view of the conveyor and the tuck fold blade of the present invention.
FIG. 4 is a bottom plan view of the conveyor of the present invention.

Turning to FIG. 3, as the material is conveyed to the feed dog it will travel from right to left in the figure. The conveyor housing 33 is cut away to show the tuck fold blade 20. The tuck fold blade 20 is retractable by means of a pivot screw 43, a pivoting arm 35, and the handle 17. The pivoting arm 35 is attached to an L-shaped bracket 36. The L-shaped bracket 36 attaches to one of a set of spacers 37. The spacers 37 connect to the sides of the conveyor housing 33.

As shown in greater detail in FIG. 5, the pivoting arm attaches to the L-shaped bracket at a pivot point on one end of the arm by means of a screw 39 with a shoulder. The screw 39 typically engages with a threaded opening 40 in the L-shaped bracket 36 and is held by a lock washer 41 (not shown) and a jam nut 42 (not shown). The handle 17 rotatably attaches to a midportion of the pivoting arm 35 by means of another screw 43 (not shown) that engages with a threaded opening 44 (not shown) in the pivoting arm. The spring 34 extends from the handle 17 to the free end of the pivoting arm 35 and causes the handle to latch to the top of the conveyor housing 33 when the tuck fold blade 29 is retracted. The tuck fold blade 29 is attached to the pivoting arm 35 by screws 45 which engage with threaded openings 46 (not shown) in the side of the pivoting arm. The biased position for the tuck fold blade is maintained by a spring 47 which extends downward in a vertical plane, surrounds the screw 18, and provides a downward force on the pivoting arm 35. The screw 18 is positioned through a slot 48 in the end of the pivoting arm 35. With the screw 18 positioned through the slot 48, the pivoting arm 35 can still move freely in its normal arc. The screw 18 fits through the spring 47, and the screw may have washers 49 for the top and bottom of the pivoting arm. Underneath the pivoting arm, a set of nuts 50 fix a low point on the screw 18 to which the pivoting arm 35 can travel.

Returning to FIG. 3, when the tuck fold blade 29 is in its biased position the blade extends down through the bottom of the conveyor 12. The end of the screw 18 fits into a threaded opening 51 on a spacer 37. The screw 18 provides a fine adjustment for adjusting the height of the tuck fold blade 29 as it extends through the bottom of the conveyor 12. In order to lower the tuck fold blade so that it extends further from the bottom of the conveyor 12, the thumbwheel on the head of screw 18 is turned clockwise which causes it to advance into the spacer 37.

In order to retract the tuck fold blade 20 from the bottom of the conveyor 12, the handle 17 is pulled backward and upward. This upward force is distributed to the free end of the pivoting arm by means of the screw 43 which attaches the handle 17 to the center of the pivoting arm 35. After the pivoting arm 35 is pulled upward by the handle 17, the pivoting arm is held in the retracted position by the spring 34 which causes the handle to latch to the top of the conveyor housing 33. The handle 17 is latched to the top of the conveyor housing 33 by means of a notch 52 in the handle. The top of the conveyor housing 33 has an opening for access to the handle 17. The housing is normally constructed of a thin gauge metal and therefore, this opening has an edge 54 which comprises a thin, flat piece of metal. The notch 52 on the handle 17 fits onto the edge 54 of the opening and holds the pivoting arm 35 in the retracted position.

Referring to FIG. 4, the bottom of the conveyor 12 has pressure plates **38*a* and 38*b* which hold the material in place as it is conveyed along the sewing platform 13. Also, the bottom of the conveyor 12 has a pair of chains 16 which grab the material and convey it to the feed dog. The pressure plate 38*a* has an opening 55 for the tuck fold blade 29 and a slot 56 at the end. Through this slot 56, the electric eye 19*b* senses the presence of material. When the electric eye 19*b* is triggered the sewing machine 11 begins to sew the material. Also, the pressure plate 38*a* positioned near the feed dog may be equipped with a recessed groove 57. The recessed groove 57** holds the tuck fold in position so that it does not come unfolded before the seam can be sewn.

The chains 16 which convey the material forward through the folder are driven by a main drive 58. At the inlet to the conveyor, a front axle 15 is shown which is driven by the chains 16. An auxiliary chain 63 is connected to the front axle for a take-off drive. The take-off drive has an axle 61 which drives a pair of wheels 64 which have a knurled surface. These wheels hold the edge of the material as the edge is trimmed. The drive system for the present invention is shown in more detail in FIG. 12.

Figure 6:
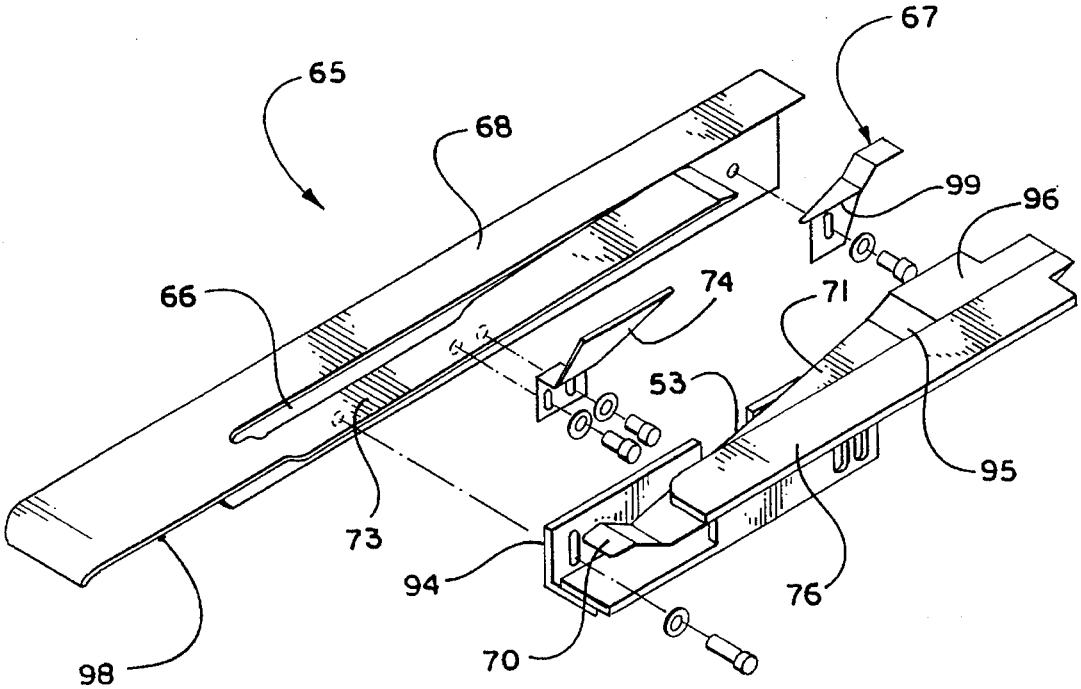
FIG. 6 is an exploded perspective view of the imitation cuff folder of the present invention.
Figure 7:
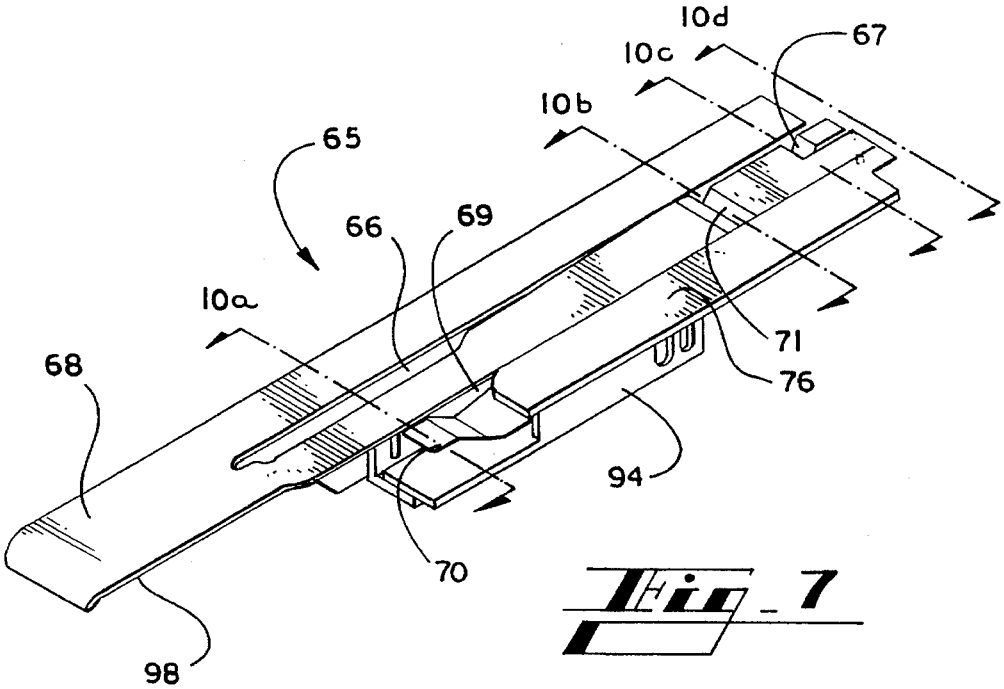
FIG. 7 is a perspective view of the imitation cuff folder of the present invention.

Referring to FIGS. 6 and 7, an imitation cuff folder 65 is shown in both a perspective and an exploded perspective view. The imitation cuff folder 65 is positioned below the conveyor on the same level as the sewing platform. The imitation cuff folder folds the material into an imitation cuff and delivers the folded material to the feed dog of the sewing machine. The imitation cuff folder 65 has an elongate folding plate 68 which defines a guide plane that is level with the sewing platform. The folding plate 68 has a folding edge 98 for forming the edge or hem fold, and the folding plate 68 has a tuck fold slot 66 down its center. The folding plate is supported by one leg of a support bracket 94. A recessed portion 73 is positioned on the folding plate 68 next to the tuck fold slot 66. This recessed portion allows the material for the tuck fold to be released from the conveyor chains for a brief period of time. As the material travels through the recessed portion 73, the material for the tuck fold is forced down into the tuck fold slot by the tuck fold blade 29 which is angled downward into the tuck fold slot 66. The folding plate is normally constructed of a thin gauge stainless steel and therefore, the narrow strip of material between the tuck fold slot 66 and the edge of the folding plate 68 may need to be supported by a stabilizer 74. At the end of the folding plate near the feed dog, a tuck fold guide 67 is attached underneath the surface of the folding plate. The tuck fold guide 67 has two straight portions connected by an angled portion. The first straight portion is below and substantially parallel to the folding plate, and the second straight portion is substantially parallel to and positioned at the same level as the guiding plane of the folding plate. Also, the tuck fold guide has a guide edge 99 which guides the material for the tuck fold.

The other leg of the support bracket 94 supports the edge fold guide 71. At the front of the edge fold guide 71, an edge fold tongue 70 provides a pick up point for the edge of the material. The edge fold tongue 70 extends above the folding plate 68 in order to ensure that the edge of the material enters the edge fold slot 69 (best shown in FIG. 7) created between the folding edge of the folding plate and the guiding edge 53 of the edge fold guide. For most of the length of the edge fold slot, the edge fold guide 71 extends horizontally below and substantially parallel to the folding plate 68. The guiding edge 53 of the edge fold guide 71 is angled inward to direct the edge of the material back underneath the body of the material to form the edge fold and in order to accomplish this task, may be equipped with a fin 97 (shown in FIG. **10*a*) which is connected to the edge adjacent to the edge fold slot and directed downward approximately perpendicular to the edge fold guide. The edge fold guide has an angled section 95 at the end of the edge fold slot which extends from the straight section below the folding plate to a second straight section 96 positioned at substantially the same level as the folding plate 68. An edge guide 76 is positioned on top of the edge fold guide 71 at the same level as the guide plane of the folding plate 68. The edge guide 76** defines the position of the finished edge of the piece of material.

In order to add piping to the imitation cuff, the piping tuck fold blade shown in FIG. 8 is required. The piping tuck fold blade 79 attaches to the pivoting arm 35 through the openings 78 in the piping tuck fold blade. The piping enters a back end 80 of the blade through a spout 81. From the sprout, the piping enters a piping feed slot 100 and makes an approximately ninety degree turn and follows the direction of the blade. Along with the change of direction, the piping rotates approximately ninety degrees from a sideways direction to a downward orientation in the tuck fold blade. Initially, the piping is threaded through the blade and the folder to its final position. Once the piping is sewn for the first time, the action of the feed dog and the conveyor pulls the piping forward to be sewn inside the tuck fold.

FIGS. **9*a* through 9*d* illustrate the orientation of the edge of the piping tuck fold blade. FIG. 9*a* shows the orientation of the edge at the point where the piping turns toward the direction of the blade. FIGS. 9***b* through 9*d* show the gradual progression from horizontal to vertical that is made along the length of the piping tuck fold blade.

Figure 10A:
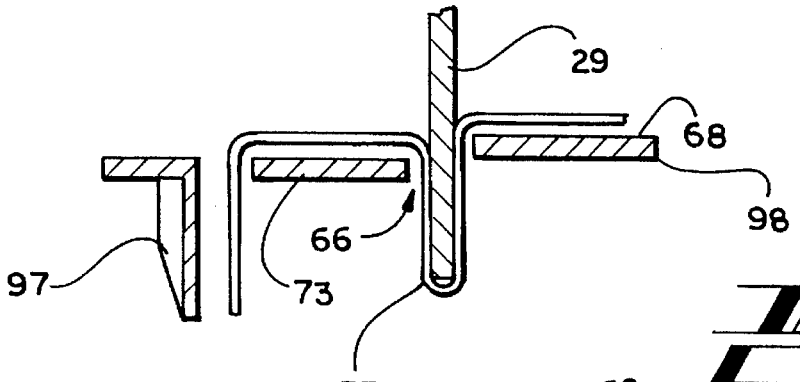
FIG. 10*a* is a front, partial elevation section view taken along lines 10*a*—10*a* of the imitation cuff folder which shows the material entering the folder.
Figure 10B:
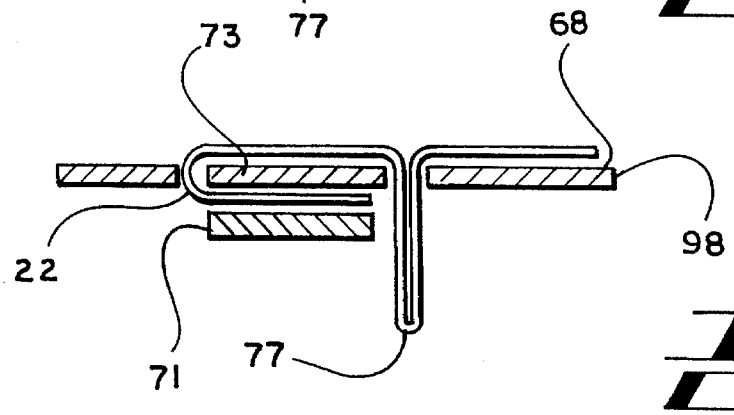
FIG. 10*b* is a front, partial elevation section view taken along lines 10*b*—10*b* of the imitation cuff folder which shows the hem fold and the loop of material which will form the tuck fold.
Figure 10C:
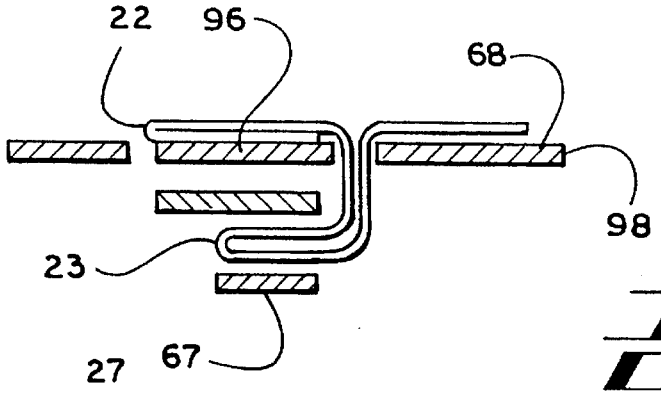
FIG. 10*c* is a front, partial elevation section view taken along lines 10*c*—10*c* of the imitation cuff folder which shows the tuck fold.
Figure 10D:
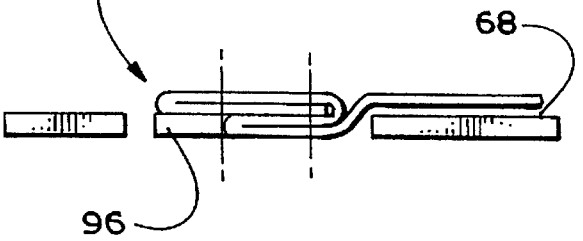
FIG. 10*d* is a front, partial elevation section view taken along lines 10*d*—10*d* of the imitation cuff folder with the final imitation cuff and lines indicating the position of the stitches.

In FIGS. 10*a* through 10*d*, the sequence of folds made by the imitation cuff folder 65 as the material passes through the folder is shown. FIG. 10*a* shows the material as it enters the slots in the imitation cuff folder. The tuck fold blade 29 is shown as it forms a loop of material 77 by extending down into the tuck fold slot 66. In FIG. 10*b* the edge fold 22 is being formed and the portion of the material which is folded under in the edge fold is positioned at the end of the horizontal section of the edge fold guide 71. From this point, the portion folded under will travel up an incline on the edge fold guide 71 to the outer surface 68, and the edge fold 22 will be completed. The loop of material 66 for the tuck fold is still oriented vertically at this point in the sequence. FIG. 10*c* shows the completed edge fold 22 and the tuck fold 23 positioned at the end of the horizontal portion of the tuck fold guide 67. From this point the tuck fold 23 will travel up an incline on the tuck fold guide 67 to the outer surface 68. Finally, FIG. 10*d* shows the completed imitation cuff 27 with lines indicating the position of the stitches.

Figure 11:
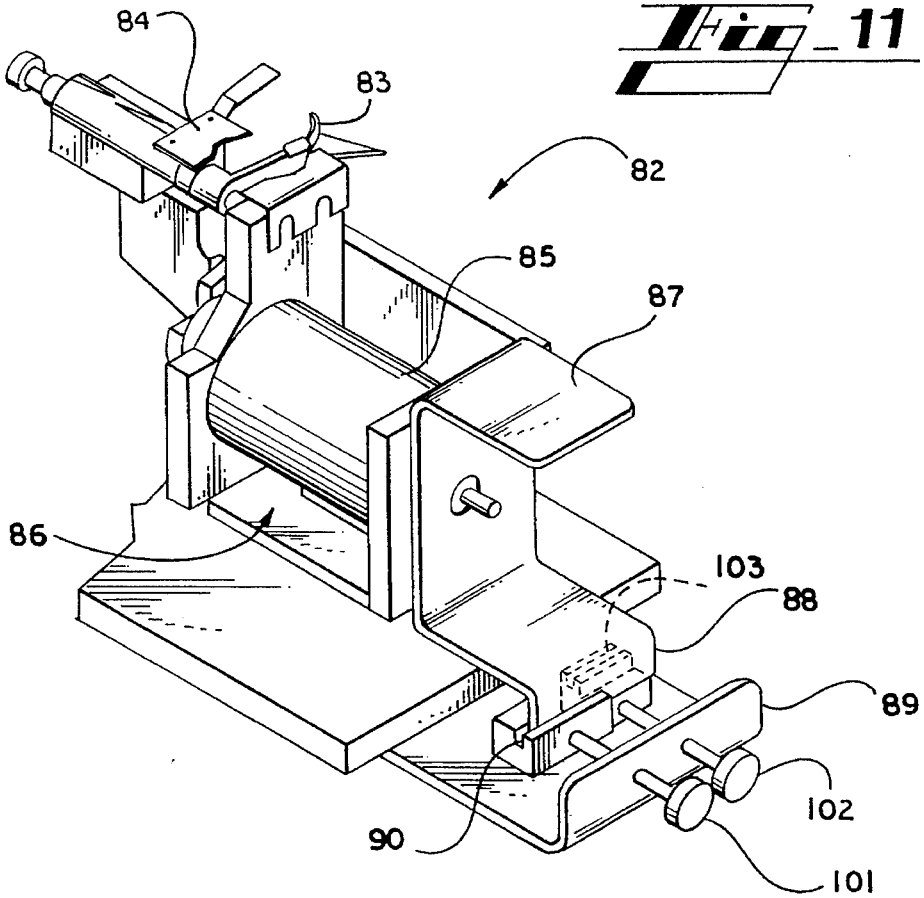
FIG. 11 is a perspective view of the edge trimmer of the present invention.

FIG. 11 shows the edge trimmer 82 detached from the system. The knife 83 has a curved member and a blade which oscillates. The edge trimmer 82 has a platform 84 which corresponds with the height of the imitation cuff folder when the system is in operation. The edge of the cloth is trimmed prior to the material reaching the imitation cuff folder. The motor 85 drives the blade in the knife 83 up and down at a high frequency. The motor mount 86 is retractable in order to allow for different positions for the knife. The necessary fine adjustments can be made by screw 101 and screw 102. The motor mount can be moved in and out by means of a knife adjustment handle 87. The knife adjustment handle 87 has a seating extension 88 at the bottom which engages with a knife position adjuster 89. The knife position adjuster has a set of grooves 90 and 103 which accept the seating extension 88 at two different positions. When the system is set for an imitation cuff, the knife 83 is moved outward to groove 90 in order to provide additional material for the tuck fold. If a standard hem operation is desired, the knife 83 can be moved inward to groove 103. The knife 83 is moved by lifting the top portion of the knife adjustment handle and moving the entire motor mount from one position on the knife position adjuster to the other position by means of positioning the seating extension 88 in the grooves 90 and 103.

Figure 12:
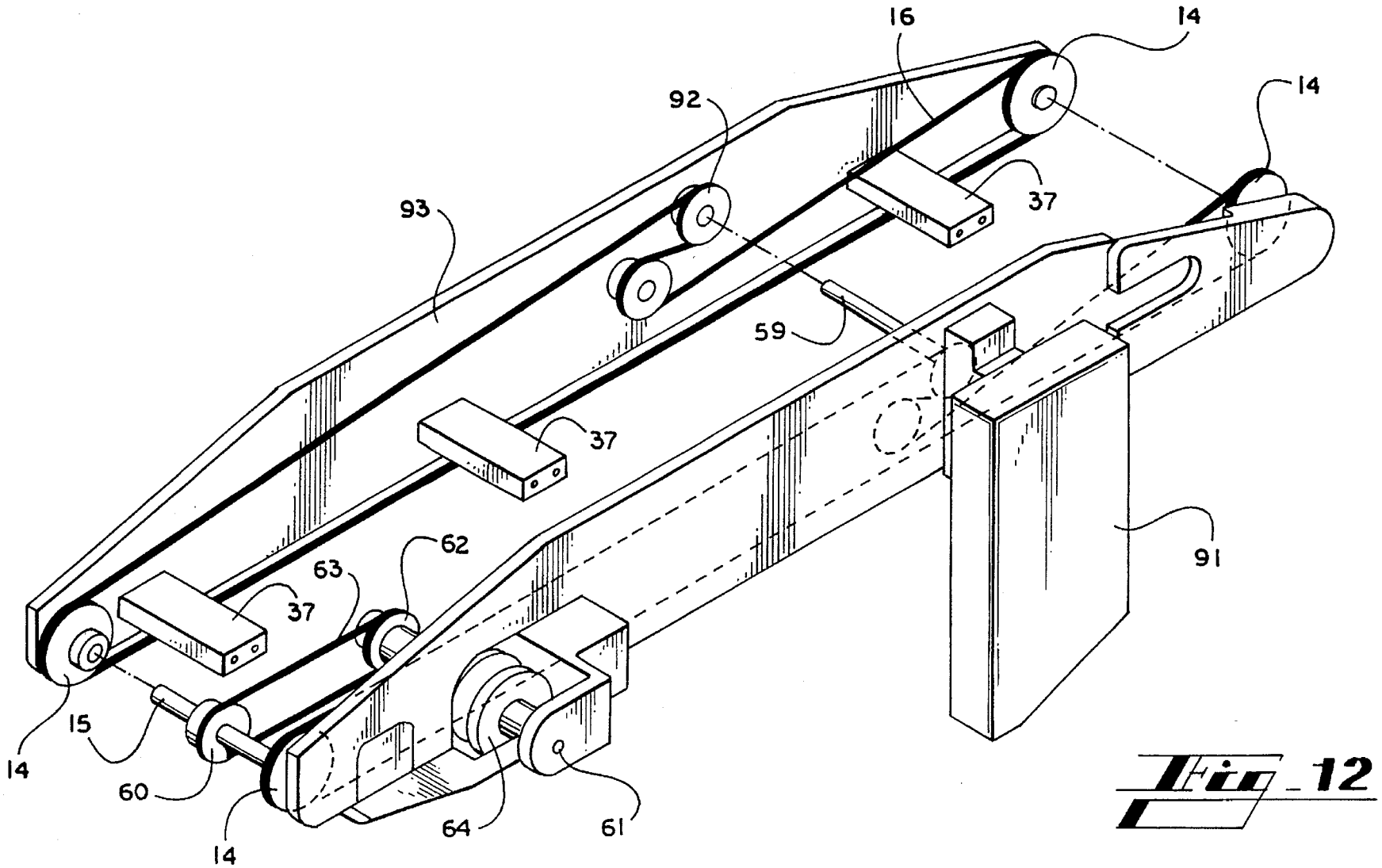
FIG. 12 is a broken away perspective view of the drive system for the conveyor of the present invention.

FIG. 12 shows the components of the drive system for the conveyor. The drive cover 91 encloses the main drive 58 which is best shown in FIG. 4. A set of drive sprockets 92 are connected to the main drive axle 59. The set of chains 16 connect the drive sprockets to the set of idler sprockets 14. At the inlet to the conveyor system, the front axle 15 positions two of the idler sprockets and a take-off drive sprocket 60. The take-off drive sprocket 60 is connected to the auxiliary idler sprocket 62 by the auxiliary chain 63. The auxiliary idler sprocket is connected to the auxiliary axle 61 (not shown). The pair of knurled wheels 64 is connected to the auxiliary axle. The knurled wheels grip the material and guide it into the edge trimming knife 83. The conveyor housing has two side walls 93 which are connected by the series of spacers 37.

Figure 13:
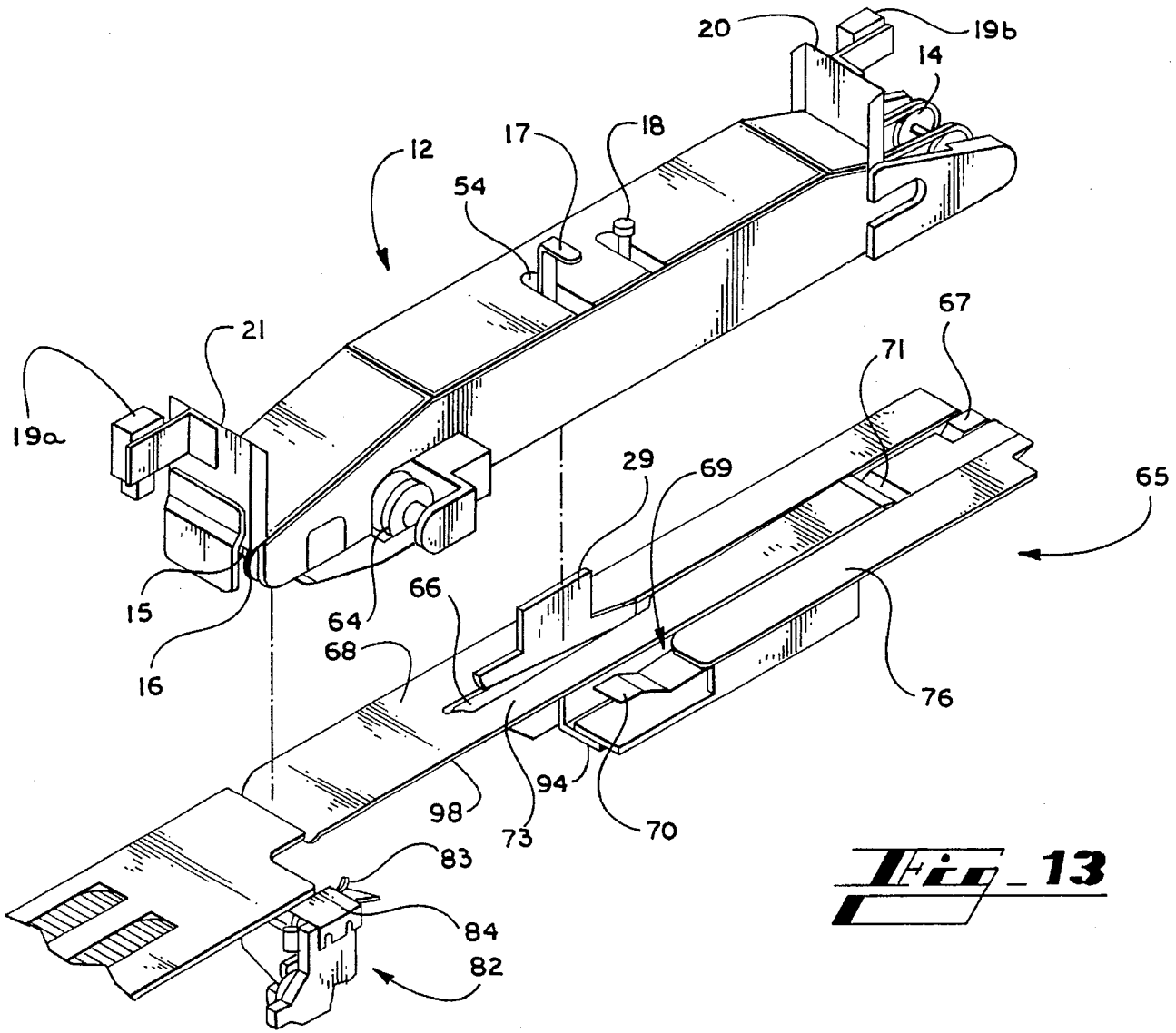
FIG. 13 is a perspective view of the system of the present invention.

FIG. 13 shows the relation between the edge trimmer 82, the conveyor 12 and the imitation cuff folder 65. The operation of the system begins with a piece of cloth being fed into the conveyor on the left hand side of the figure. The conveyor chain 16 conveys the material to the knurled wheels 64 which hold the edge of the material as it is fed through the edge trimmer 82. The edge is trimmed by a knife 83 with an oscillating blade. After the cloth passes through the edge trimmer, the trimmed cloth is conveyed through the imitation cuff folder 65. The edge of the cloth enters the edge fold slot 69 under the edge fold tongue 70. Once inside the edge fold slot the material is guided along the guide edge of the edge fold guide 71. The edge fold guide directs the trimmed edge up and under the rest of the piece of material to form the edge fold 22. The edge fold guide 71 creates the edge fold and returns it to the same level as the folding plate 68 where it travels to the feed dog.

As the edge of the cloth enters the edge fold slot 69, the tuck fold blade 29 catches the material and forms the loop of material 77 which is guided down into the tuck fold slot 66. The recessed portion 73 in the folding plate 68 releases the material from the conveyor chains 16 so that the amount of material necessary for the tuck fold 23 can be pulled into the tuck fold slot 66 by the tuck fold blade 29. Once inside the tuck fold slot 66, the loop of material 77 is guided up and under the edge fold by the tuck fold guide 67. The tuck fold overlaps the trimmed edge of the material when it is in its final position. The tuck fold guide extends to the end of the folding plate 68 so that the tuck fold is positioned adjacent to the feed dog on the sewing machine. This location is important to maintaining the positioning of the tuck fold until the piece of cloth material is sewn.

Various modifications may be made of the invention without departing from the scope thereof and it is desired, therefore, that only such limitations shall be placed thereon as are imposed by the prior art and which are set forth in the appended claims.

What is claimed is:

1. A system for automatically sewing an imitation cuff hem on a piece of cloth material, the system attaching to a sewing machine at a position adjacent to a feed dog on the machine, the system comprising:

conveyor means for conveying the piece of cloth material, the conveyor means having a material contact side, the material contact side having an opening, edge trimming means for trimming an edge of the piece of cloth material, the edge trimming means positioned adjacent to the conveyor means, a tuck fold blade connected to the conveyor means and extending through the opening in the material contact side of the conveyor means for forming a loop of material, an elongate folding plate having a tuck fold slot and a folding edge, the folding plate having a recessed portion next to the tuck fold slot, a bracket connected to the folding plate, a tuck fold guide having a guide edge, the tuck fold guide connected to the bracket, the guide edge positioned next to the tuck fold slot to guide the loop of material to form a tuck fold, an edge fold guide having a guiding edge, the edge fold guide connected to the bracket, the guiding edge positioned adjacent to the folding edge to guide an edge of the material to form an edge fold, an edge fold tongue extending from the edge fold guide, and an edge guide attached to the edge fold guide, the edge guide positioned adjacent to the folding edge of the folding plate to form an edge fold slot.

2. The system as claimed in claim 1, wherein the edge trimming means further comprises a knife adjustment handle connected to the edge trimming means, the knife adjustment handle having a seating extension, and a knife position adjuster having a groove which accepts the seating extension.

3. The system as claimed in claim 1 further comprising a stabilizer connected to the bracket, the stabilizer juxtaposed with the folding plate between the tuck fold slot and the edge fold slot.

4. The system as claimed in claim 1, wherein the tuck fold blade further comprises:

the tuck fold blade having a material contact edge, and a piping feed slot located along the material contact edge of the tuck fold blade, the piping feed slot having a proximate end and a distal end, the proximate end of the piping feed slot having an opening, the distal end of the piping feed slot having a opening, the piping feed slot having a necked down portion between the proximate end and the distal end, the piping feed slot rotating approximately ninety degrees between the necked down portion and the distal end of the piping feed slot.

5. The system as claimed in claim 1, wherein the tuck fold blade further comprises:

a pivoting arm connected to the tuck fold blade, the pivoting arm having a first end and a second end, the pivoting arm having an opening at the first end, the pivoting arm having a slot at the second end, a handle attached to the pivoting arm, the handle having a notch, the notch attaching to the conveyor means when the tuck fold blade is retracted, a bracket attached to the conveyor means, the bracket having an opening, the bracket attached to the first end of the pivoting arm, the pivoting arm rotatably attached to the bracket through the opening in the bracket, fastener means positioned in the slot in the second end of the pivoting arm for establishing a lower limit of travel for the second end of the pivoting arm, and a spring connected between the handle and the pivoting arm.

6. The system as claimed in claim 5, wherein the fastener means further comprises:

a fastener positioned in the slot in the second end of the pivoting arm and having a thumbwheel, the fastener having a set of threads which engage with the conveyor means, the fastener having a pair of nuts threaded onto the fastener and positioned adjacent to each other, a first washer surrounding the fastener and positioned between the thumbwheel and the pivoting arm, a second washer surrounding the fastener and positioned between the pair of nuts and the pivoting arm, and a second spring surrounding the fastener, the second spring positioned between the thumbwheel and the first washer.

7. The system as claimed in claim 1, wherein the conveyor means comprises:

a conveyor housing having two side walls, a first surface, and a material contact surface, the material contact surface having a slot, a main drive coupled to the side wall of the conveyor housing, the main drive having an axle, a plurality of drive sprockets attached to the axle on the main drive, a plurality of idler sprockets, the idler sprockets positioned at opposite ends of the conveyor housing, a front axle connected to the idler sprockets, a take-off drive sprocket connected to the front axle, an auxiliary idler sprocket connected to the take-off drive sprocket by a chain, an auxiliary axle driven by the auxiliary idler sprocket, and a pair of knurled wheels connected to the auxiliary axle.

8. The system as claimed in claim 1, wherein the conveyor means further comprises a plurality of pressure plates forming the material contact side.

9. The system as claimed in claim 8, wherein the conveyor means further comprises the pressure plates having a recessed groove, the recessed groove located adjacent to the feed dog on the sewing machine.

10. A system for automatically sewing an imitation cuff hem on a piece of cloth material, the system attaching to a sewing machine at a position adjacent to a feed dog on the machine, the system comprising:

conveyor means for conveying the piece of cloth material, the conveyor means having a material contact side, the material contact side having an opening, edge trimming means for trimming an edge of the piece of cloth, the edge trimming means positioned adjacent to the conveyor means, a tuck fold blade connected to the conveyor means and extending through the opening in the material contact side of the conveyor means for forming a loop of material, an elongate folding plate having a first surface, a second surface, a folding edge, and a tuck fold slot, the folding plate juxtaposed with the material contact side of the conveyor means, the folding plate having a recessed portion adjacent to the tuck fold slot, the first surface of the plate defining a horizontal guide plane, a bracket having a first leg and a second leg, the first leg of the bracket connected to the second surface of the folding plate, a tuck fold guide having a first section, a second section, and an angled section, the tuck fold guide connected to the first leg of the bracket, the tuck fold guide positioned adjacent to the tuck fold slot, the first section of the tuck fold guide having a guide edge which guides the loop of material to form a tuck fold, the first section of the tuck fold guide positioned below and substantially parallel to the guide plane, the second section of the tuck fold guide positioned in the guide plane, the angled section of the tuck fold guide connecting the first section to the second section, the tuck fold guide having a fin which is connected to the guide edge of the first section of the tuck fold guide, an edge fold guide connected to the second leg of the bracket, the edge fold guide having a first section, a second section, and an angled section, the first section of the edge fold guide having a guide edge which guides an edge of the material, the first section of the edge fold guide positioned below and substantially parallel to the guide plane, the second section of the edge fold guide positioned in the guide plane, the angled section connecting the first and second section, the edge fold guide having a fin which is connected to the guide edge of the first section of the edge fold guide, an edge fold tongue connected to the first section of the edge fold guide, the edge fold tongue extending above the guide plane, and an edge guide attached to the first section of the edge fold guide, the edge guide positioned adjacent to the folding edge of the folding plate to form an edge fold slot, the edge guide positioned in the guide plane.

11. The system as claimed in claim 10, wherein the edge trimming means further comprises a knife adjustment handle connected to the edge trimming means, the knife adjustment handle having a seating extension, and a knife position adjuster having a groove which accepts the seating extension.

12. The system as claimed in claim 10 further comprising a stabilizer connected to the first leg of the bracket, the stabilizer juxtaposed with the second surface of the folding plate between the tuck fold slot and the edge fold slot.

13. The system as claimed in claim 10, wherein the tuck fold blade further comprises:

the tuck fold blade having a material contact edge, and a piping feed slot located along the material contact edge of the tuck fold blade, the piping feed slot having a proximate end and a distal end, the proximate end of the piping feed slot having an opening, the distal end of the piping feed slot having a opening, the piping feed slot having a necked down portion between the proximate end and the distal end, the piping feed slot rotating approximately ninety degrees between the necked down portion and the distal end of the piping feed slot.

14. The system as claimed in claim 10, wherein the tuck fold blade further comprises:

a pivoting arm connected to the tuck fold blade, the pivoting arm having a first end and a second end, the pivoting arm having an opening at the first end, the pivoting arm having a slot at the second end, a handle attached to the pivoting arm, the handle having a notch, the notch attaching to the conveyor means when the tuck fold blade is retracted, a bracket attached to the conveyor means, the bracket having an opening, the bracket attached to the first end of the pivoting arm, the pivoting arm rotatably attached to the bracket through the opening in the bracket, fastener means positioned in the slot in the second end of the pivoting arm for establishing a lower limit of travel for the second end of the pivoting arm, and a spring connected between the handle and the pivoting arm.

15. The system as claimed in claim 14, wherein the fastener means further comprises:

a fastener positioned in the slot in the second end of the pivoting arm and having a thumbwheel, the fastener having a set of threads which engage with the conveyor means, the fastener having a pair of nuts threaded onto the fastener and positioned adjacent to each other, a first washer surrounding the fastener and positioned between the thumbwheel and the pivoting arm, a second washer surrounding the fastener and positioned between the pair of nuts and the pivoting arm, and a second spring surrounding the fastener, the second spring positioned between the thumbwheel and the first washer.

16. The system as claimed in claim 10, wherein the conveyor means comprises:

a conveyor housing having two side walls, a first surface, and a material contact surface, the material contact surface having a slot, a main drive coupled to the side wall of the conveyor housing, the main drive having an axle, a plurality of drive sprockets attached to the axle on the main drive, a plurality of idler sprockets, the idler sprockets positioned at opposite ends of the conveyor housing, a front axle connected to the idler sprockets, a take-off drive sprocket connected to the front axle, an auxiliary idler sprocket connected to the take-off drive sprocket by a chain, an auxiliary axle driven by the auxiliary idler sprocket, and a pair of knurled wheels connected to the auxiliary axle.

17. The system as claimed in claim 10, wherein the conveyor means further comprises a plurality of pressure plates forming the material contact side.

18. The system as claimed in claim 17, wherein the conveyor means further comprises the pressure plates having a recessed groove, the recessed groove located adjacent to the feed dog on the sewing machine.

* * * * *